US007631682B2

(12) United States Patent
Lamers et al.

(10) Patent No.: US 7,631,682 B2
(45) Date of Patent: Dec. 15, 2009

(54) RETRACTABLE WINDOW COVERING HAVING A LENGTH EXPANDING STIFFENING ROD

(75) Inventors: Franciscus Cornelis Gerardus Lamers, Hoensbroek (NL); Jan Pieter Wetsema, Rotterdam (NL); Hans de Lange, Denekamp (NL)

(73) Assignee: Hunter Douglas Industries BV, El Rotterdam (NL)

( * ) Notice: Subject to any disclaimer, the term of this patent is extended or adjusted under 35 U.S.C. 154(b) by 166 days.

(21) Appl. No.: 11/778,774

(22) Filed: Jul. 17, 2007

(65) Prior Publication Data

US 2008/0017327 A1 Jan. 24, 2008

(30) Foreign Application Priority Data

Jul. 21, 2006 (EP) ..... 06015275

(51) Int. Cl.
*E06B 3/94* (2006.01)

(52) U.S. Cl. ..... 160/84.06; 160/DIG. 16

(58) Field of Classification Search ..... 160/84.06, 160/84.04, 84.07, 264, 280, 281, 282, 283, 160/284, 285, 286, 287, 288, DIG. 16
See application file for complete search history.

(56) References Cited

U.S. PATENT DOCUMENTS

| | | | | | |
|---|---|---|---|---|---|
| 3,467,973 | A | * | 9/1969 | Minnick | 5/719 |
| 3,487,875 | A | | 1/1970 | Shukat et al. | |
| 3,777,800 | A | * | 12/1973 | Susoev | 160/84.04 |
| 4,777,673 | A | | 10/1988 | Patteson et al. | |
| 4,880,045 | A | * | 11/1989 | Stahler | 160/84.04 |
| 5,111,866 | A | | 5/1992 | Prostko | |
| 5,275,221 | A | * | 1/1994 | Doehlemann | 160/84.04 |
| 2005/0109468 | A1 | | 5/2005 | Hsu | |

FOREIGN PATENT DOCUMENTS

| | | | |
|---|---|---|---|
| CA | 2 486 333 | A1 | 4/2006 |
| DE | G83 18 292 | U1 | 10/1983 |
| DE | 36 15 349 | A1 | 11/1987 |
| DE | 36 31 919 | A1 | 4/1988 |
| DE | 43 23 993 | A1 | 3/1994 |
| DE | 44 19 410 | A1 | 12/1995 |
| DE | 202 17 015 | U1 | 3/2003 |
| EP | 0 451 912 | A1 | 10/1991 |
| FR | 2 541 363 | | 8/1984 |
| WO | WO 2005/040543 | A1 | 5/2005 |

* cited by examiner

*Primary Examiner*—David Purol
(74) *Attorney, Agent, or Firm*—Dorsey & Whitney LLP

(57) ABSTRACT

A retractable window covering that has a flexible fabric panel having a bottom edge with a weight bar attached to it. The fabric panel has one or more elongate pockets across its width, accommodating a length-expanding stiffening rod with:

an elongate guiding element of non-magnetic material;

a first magnet guided for movement along the elongate guiding element; and a second magnet guided for movement along the elongate guiding element and positioned in respect of the first magnet, so that the first and second magnets repulse one another and the guiding element limits and guides the movement of the first and second magnets in respect to one another.

4 Claims, 3 Drawing Sheets

RETRACTABLE WINDOW COVERING HAVING A LENGTH EXPANDING STIFFENING ROD

CROSS REFERENCE TO RELATED APPLICATION

This application claims priority to European Application No. 06015275.8, filed 21 Jul. 2006, and such application is hereby incorporated by reference as if fully disclosed herein.

BACKGROUND OF THE INVENTION

The present invention relates to a curtain stiffener rod for a retractable window covering.

Examples of such window coverings, using foldable curtain material and stiffening rods are described in, amongst others, U.S. Pat. No. 3,487,875, DE 3615349, DE 3631919, DE 4323993, DE 4419410, and EP 0451912.

With these conventional window coverings it has been customary to create open tunnels on the curtain fabric into which the stiffening rods can be inserted endwise. Because often this has required additional measures to retain the stiffening rods in position with respect to the fabric, it has also become customary to hem the fabric after insertion of the stiffening rods and thereby close off the open ends of the tunnels.

While this hemming has successfully located the stiffening rods, it has also impaired the ability to wash the window covering fabric, in that it was thereby no longer possible to remove the stiffener rods. A solution to this problem was proposed by FR 2541363, which discloses the use of openings inwardly of one of the hems, on one end of the tunnels. Through these openings the stiffening rods can be inserted and removed, while retaining the stiffening rods in use.

This solution has worked to a certain extend, but it has required either the fabric to be sufficiently elastic or the stiffener rods to be shorter than the full width of the fabric. The fabric materials used for the subject foldable curtain window coverings need to be form stable and fabric with elastic properties is thereby out of the question, as it would compromise the decorative properties of this type of window coverings. It has thus sometimes been difficult to insert a stiffener rod that completely fills out the pocket into which it is inserted from an inwardly positioned slit or button hole by stretching and relaxing the fabric over the end of the rod. The use of slightly shorter rods that do not completely fill out the entire pocket has proven not to be a practical option, as it has not sufficiently prevented the fabric to ripple by changes in humidity and thereby resulted in objectionable looks.

Accordingly it has become customary to use stiffening rods with a variable length, such as those proposed by DE G 83 18 292 U1. Such telescopic rods on one of their longitudinal ends have an end part that is biased by a compression spring to expand the rod beyond its compressed length. This has enabled the rod to be inserted through a hole in the tunnel that is positioned inwardly of a lateral hem and allowed the rod to expand after its insertion to completely occupy the pocket formed by a tunnel and opposite lateral hems. Nonetheless it has been difficult to control the appropriate spring force and range of length variation, as different fabrics and dimensional tolerances in the fabric have required different spring forces. This has been both a nuisance in stock keeping and in achieving an optimum result. The use of compression springs has also been a cause of unsightly deformations in a number of circumstances beyond the control of the manufacturer.

BRIEF SUMMARY OF THE INVENTION

Accordingly it is an object of the present invention to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice.

To this end the present invention provides a retractable window covering, including:

a support member adapted to be secured to a building surface; a flexible fabric panel having a first edge secured to the support member and a second edge depending downwardly; a weight bar attached to the second edge; a retraction mechanism associated with the support member for raising and lowering the weight bar and thereby retracting the fabric panel; the fabric panel being provided with at least one elongate pocket across its width, accommodating a length expanding stiffening rod;

the stiffening rod has an end element having: an elongate guiding element of non-magnetic material; a first magnet guided for movement along the elongate guiding element; a second magnet guided for movement along the elongate guiding element and positioned in respect of the first magnet, effective for the first and second magnets to repulse one another and whereby the guiding element limits and guides the movement of the first and second magnets in respect to one another.

DESCRIPTION OF THE PREFERRED EMBODIMENTS

Figure 1:
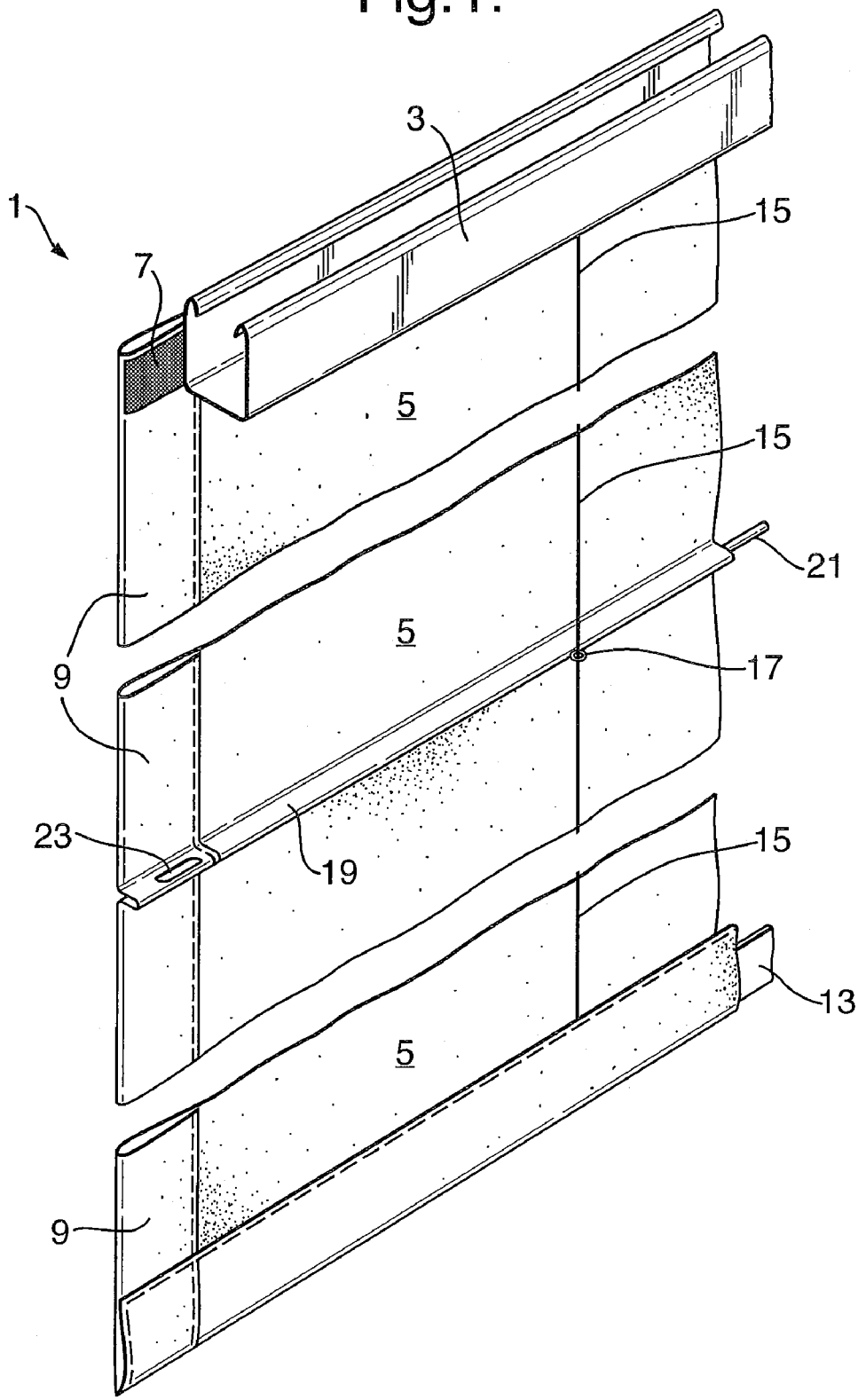
FIG. 1 is a perspective view of one form of retractable window covering according to the invention.

Referring first to FIG. 1 there is shown a retractable window covering in the form of a roman shade 1. The roman shade 1 includes a support member in the shape of a head rail 3 and a sheet of fabric material 5. The sheet of fabric 5 is preferably confectioned with a strip of Velcro material 7 to its upper margin, which cooperates with a strip of similar material attached to the head rail 3. This manner of removable attachment of a window covering fabric to a head rail is conventional and needs no further description. The sheet of fabric 5 is also provided with a hem 9 on a lateral margin and a similar hem 11 to a lower margin. The lower hem 11 conveniently houses a weight bar 13 to assist in its lowering. Also attached to the lower hem 11 is one of at least a pair of lift cords 15, which are operative to retract the bottom hem 11 and weight bar 13 towards the head rail 3 in a conventional manner.

The lift cord 15 is further guided by an eyelet 17 attached to an elongate transverse pocket or tunnel 19 formed onto the fabric 5. While for ease of reference one such tunnel 19 is shown, these can be repeated at will at regular intervals along the height of the fabric panel 5. It is further seen in FIG. 1, that the elongate pocket 19 accommodates a stiffening rod 21. This stiffening rod 21, it is to be understood, fills out the inside of the pocket 19 between a hemmed lateral margin (such as 9) on each opposite side of the fabric panel 5. To remove and reinsert the stiffening rod 21 from, and into, the pocket 19 there is provided an inwardly positioned button hole 23, giving access to the interior of the pocket formation 19.

Figure 2:
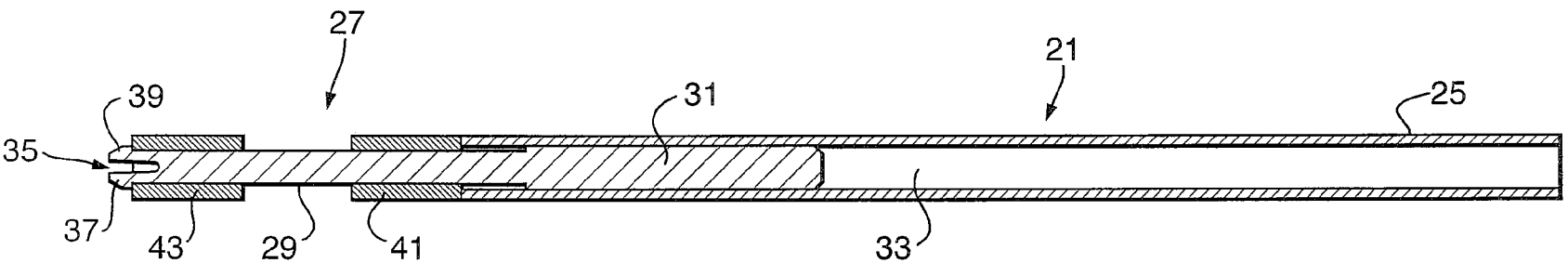
FIG. 2 is a longitudinal cross section through the stiffener rod forming part of the invention.
Figure 3:
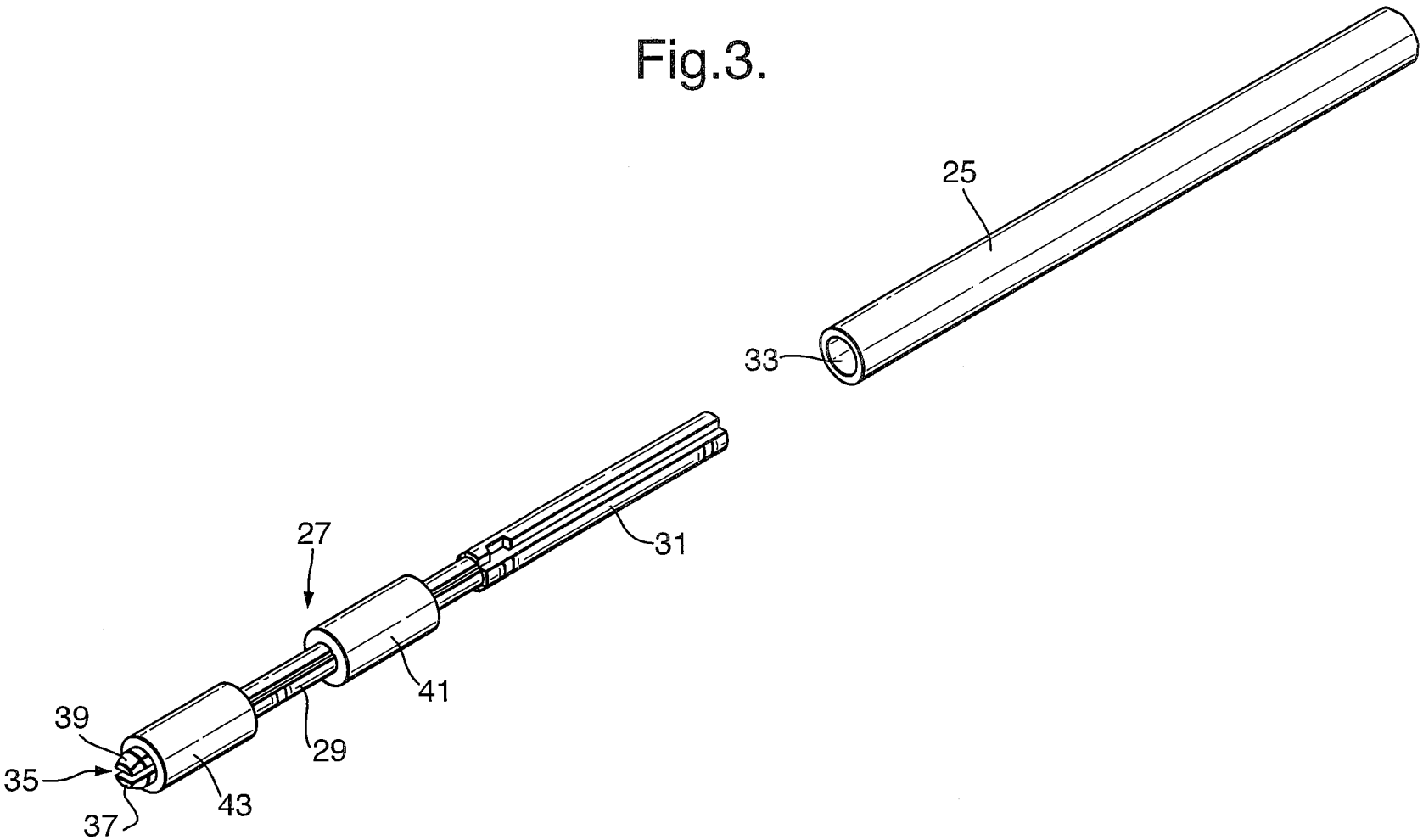
FIG. 3 is a perspective partly exploded view of the stiffener rod of FIG. 2.

As explained above a length expandable and compressible type of stiffening rod 21 is preferred for this type of application. The particular rod forming part of the present invention is illustrated in FIG. 2 and includes a generally tubular member 25 and an end element 27. The end element 27 includes an elongate guiding element, here in the form of a shaft 29. The elongate shaft-like guiding element 29 on one end portion of its length has an enlarged cross-section 31 which is adapted in size and shape to fit slidingly within the hollow interior 33 of the tubular member 25. The opposite end 35 of the shaft like end element 29 is bifurcated and has flexible detents 37 and 39, which extend radially beyond the diameter of the main shaft portion 29. Slidingly engaged around the shaft 29 are a first magnet 41 and a second magnet 43. The elongate guiding element is preferably of a non-magnetic material. The first and second magnet 41, 43 can be identical and preferably are selected to be identical to simplify stock keeping. Both the first and second magnets 41, 43 are annularly shaped and preferably formed from rare earth materials selected from the group that comprises Neodymium, Iron and Boron. Such magnetic material has a high energy and coercivity. When the second magnet 43 is positioned with respect to the first magnet 41 to repulse, then the first magnet will be forced against the enlarged cross section end 31 and the first magnet is forced against the detents 37, 39 as shown in FIG. 3. Applying a moderate force against the exposed bifurcated end 35 will move the enlarged section 31 further into the tubular end rod 25 as shown in FIG. 2, because the first magnet 41 has substantially the same outside diameter as the tubular rod 25. Using this effect, allows the preassembled stiffening rod 1 as shown in FIG. 2 to be introduced through the button hole 23 of the elongate pocket 19 of the window covering 1 shown in FIG. 1. Thereby the bifurcated end 35 can pass the inwardly positioned button hole 23 and expand to the full length of the pocket 19 afterwards.

It has been found important that the expanding force is only moderate, so as not to deform in any way the fabric material of the window covering. Similarly it has been found important that the stiffening rod fills the entire pocket across the fabric panel and that it does so automatically. Helical springs have been proposed for this purpose, but have only allowed a limited range if expansion so as to keep the expansion force within narrow limits. Also these springs have been covered with sleeves extending beyond the diameter of the stiffener rods, so as to prevent the spring windings from becoming entangled with the interstices of the fabric material. The length expanding stiffening rod used in the present invention does not have any of the aforementioned drawbacks.

It is thus believed that the operation and construction of the present invention will be apparent from the foregoing description. The term comprising when used in this description or the appended claims should not be construed in an exclusive or exhaustive sense but rather in an inclusive sense. Expressions such as: "means for . . . ". should be read as: "component configured for . . . " or "member constructed to . . . " and should be construed to include equivalents for the structures disclosed. The use of expressions like: "critical", "preferred", "especially preferred" etc., is not intended to limit the invention. Features which are not specifically or explicitly described or claimed may be additionally included in the structure according to the present invention without deviating from its scope.

The invention is further not limited to any embodiment herein described and, within the purview of the skilled person, modifications are possible which should be considered within the scope of the appended claims. Equally all kinematic inversions are to be considered within the scope of the present invention.

The invention claimed is:

1. Retractable window covering, including:

a support member adapted to be secured to a building surface;

a flexible fabric panel having a first edge secured to the support member and a second edge depending downwardly;

a weight bar attached to the second edge;

a retraction mechanism associated with the support member for raising and lowering the weight bar and thereby retracting the fabric panel;

the fabric panel being provided with at least one elongate pocket across its width, accommodating a length expanding stiffening rod; the stiffening rod comprising:

an elongated member with an open end and a hollow interior, an elongated guiding element having a large outer diameter at one end slidably fitted within said hollow interior and a relatively smaller outer diameter at an opposite end protruding from said open end of said elongated member, a pair of magnets fitted on said relatively smaller outer diameter portion of said guiding element, at least one of said magnets being slidably fitted on said relatively smaller outer diameter portion, said guiding element having a resilient enlarged end at said relatively smaller outer diameter portion permitting said magnets to be fitted onto said guiding element and retained thereon by said enlarged end whereby said magnets bias said guiding element axially outwardly of said open end of said elongated member while allowing said guiding element to be yieldingly slid into said elongated member.

2. Retractable window covering according to claim 1, wherein the first and second magnets each have a central aperture for engaging the shaft.

3. Retractable window covering according to claim 2, wherein each of the first and second magnets is annular in shape.

4. Retractable window covering according to claim 1, wherein the retraction mechanism uses lift cords to retract the fabric panel.

* * * * *